United States Patent [19]

Youngblood

[11] 4,010,808

[45] Mar. 8, 1977

[54] EXPANDABLE RAISE BIT

[75] Inventor: Thomas Franklin Youngblood, Desoto, Tex.

[73] Assignee: Dresser Industries, Inc., Dallas, Tex.

[22] Filed: Sept. 22, 1975

[21] Appl. No.: 615,736

[52] U.S. Cl. ..... 175/334; 175/342; 175/384; 175/391

[51] Int. Cl.[2] ..... E21B 9/24

[58] Field of Search ..... 175/53, 344, 334, 342, 175/381, 383, 319, 384, 391, 392

[56] References Cited

UNITED STATES PATENTS

| | | | |
|---|---|---|---|
| 1,375,094 | 4/1921 | Humason | 175/342 X |
| 1,467,479 | 9/1923 | Henritzi | 175/384 X |
| 2,086,751 | 7/1937 | Taylor | 175/342 X |
| 2,783,974 | 3/1957 | Veasman | 175/391 X |
| 2,998,964 | 9/1961 | Morlan | 175/384 X |
| 3,016,099 | 1/1962 | Woodruff | 175/344 |
| 3,215,214 | 11/1965 | Caro | 175/334 X |
| 3,302,983 | 2/1967 | Garrett | 175/325 X |
| 3,358,782 | 12/1967 | Bechem | 175/344 |
| 3,386,520 | 6/1968 | Lawrence et al. | 175/381 X |
| 3,659,660 | 5/1972 | Conn | 175/53 |

FOREIGN PATENTS OR APPLICATIONS

| | | | |
|---|---|---|---|
| 1,216,822 | 5/1966 | Germany | 175/391 |
| 999,967 | 7/1965 | United Kingdom | 175/391 |

*Primary Examiner*—Ernest R. Purser
*Assistant Examiner*—Richard E. Favreau
*Attorney, Agent, or Firm*—Eddie E. Scott

[57] ABSTRACT

A bit is provided that includes a bit body defining a bit axis of rotation. Primary cutter means are positioned on the bit body for disintegrating the formations out to a first radial distance from said bit axis of rotation. Secondary cutter means are adapted to be connected to the bit body and selectively located in a first position for cutting between said first radial distance and a larger second radial distance and selectively located in a subsequent position between said first radial distance and an even larger subsequent radial distance. Expansion means are provided to be located between said secondary cutter means and said bit body for locating said secondary cutter means in said subsequent position.

2 Claims, 4 Drawing Figures

EXPANDABLE RAISE BIT

BACKGROUND OF THE INVENTION

The present invention relates to the art of earth boring and, more particularly, to a raise bit for enlarging a first hole into a second hole having a larger diameter.

A relatively large diameter hole may be provided between a first location and a second location in a mine or other location by an operation commonly referred to as raise drilling. A raise drilling operation begins by drilling a small diameter pilot hole through the earth from a first location to an opening at the second location using a small diameter pilot bit. After the pilot hole is completed, the pilot bit is removed from the drill string and a large diameter raise bit attached. The raise bit is rotated and drawn along the pilot hole, thereby enlarging the pilot hole to the desired size. The hole thus formed may be further enlarged to a larger diameter hole by drawing a larger raise bit along said hole.

On many occasions, the hole to be enlarged extends to an area accessible only through a small drift or passage, and very little headroom is available for the raise bit. This creates difficulties when attempting to connect the raise bit to the drill string. It is, therefore, desirable to provide a raise bit that can be expanded to encompass a variety of large diameters without increasing the overall height of the bit. It is also desirable to provide a single raise bit that can be utilized to bore large diameter holes of various sizes. As shown in U.S. Pat. No. 3,659,659 to Carl L. Lichte, patented May 2, 1972, raise bits of the prior art generally include a bit body positioned about a central bit axis with rolling cutters mounted at various distances from the central bit axis for disintegrating the earth formations. The rolling cutters may be locked in place on the bit by various locking mechanisms. For example, locking mechanisms are shown in U.S. Pat. No. 3,203,492 to C. L. Lichte, patented Aug. 31, 1965; in U.S. Pat. No. 3,705,635 to William M. Conn patented Dec. 12, 1972; and in U.S. Pat. No. 3,612,196 to Robert L. Dixon patented Oct. 12, 1971. The cutters may be positioned to cut the working face according to various geometries. For example, cutter locations are shown in U.S. Pat. Re. No. 27,597 to M. L. Talbert patented Mar. 13, 1973, in U.S. Pat. No. 3,805,901 to William D. Coski, patented Apr. 23, 1974, and in U.S. Pat. No. 3,638,740 to Dan B. Justman, patented Feb. 1, 1972. A lubrication system may be provided to transmit lubricant to the bearings of the rolling cutters, as shown in U.S. Pat. No. 3,675,729 to William J. Neilson, patented July 11, 1972.

DESCRIPTION OF PRIOR ART

In U.S. Pat. No. 3,659,660 to William M. Conn, patented May 2, 1972, a large diameter bit for shallow angle holes is shown. The bit includes a plurality of drilling stages surrounding a central shaft. Integral stabilization sections are included after each drilling stage.

In U.S. Pat. No. 3,231,029 to Douglas F. Winberg, patented Jan. 25, 1966, an articulated drilling shaft for raise drilling is shown. The raise drilling bit shown in this patent includes a follower having an effective diameter when rotating that is substantially equal to the diameter of the raise hole that is being drilled by the cutterhead.

In U.S. Pat. No. 3,866,698 to John M. Stanley, patented Feb. 18, 1975, a raise drilling bit is shown for producing a raise bore about a pilot hole including a drill head having an upper surface for mounting cutter assemblies. A lower surface is spaced from said upper surface and has a drive stem attached thereto. The drive stem is adapted for a limited or floating movement with respect to said upper mounting surface.

SUMMARY OF THE INVENTION

The present invention provides a raise bit that is expandable and is useful for boring holes of various diameters. The raise bit of the present invention can be expanded to various diameters without increasing the overall height of the bit. The raise bit of the present invention may be used for enlarging a first hole into a larger second hole. The bit includes a bit body defining a bit axis of rotation. Primary cutter means are positioned on the bit body for disintegrating the formations out to a first radial distance from said bit axis of rotation. Secondary cutter means are adapted to be connected to the bit body and selectively located in a first position for disintegrating the formations between said first radial distance from said bit axis of rotation and a second radial distance from said bit axis of rotation greater than said first radial distance. Said secondary cutter means may be selectively located in a subsequent position for disintegrating the formations between said first radial distance from said bit axis of rotation and a subsequent radial distance greater than said second radial distance. Expansion means are provided and adapted to be located between said secondary cutter means and said bit body for locating said secondary cutter means in said subsequent position. The expansion means are added between said bit body and secondary cutter means to increase the radius of the bit in increments without increasing the overall height of the bit. The above and other features and advantages of the present invention will become apparent from a consideration of the following detailed description of the invention when taken in conjunction with the accompanying drawings.

DETAILED DESCRIPTION OF THE INVENTION

Figure 1:
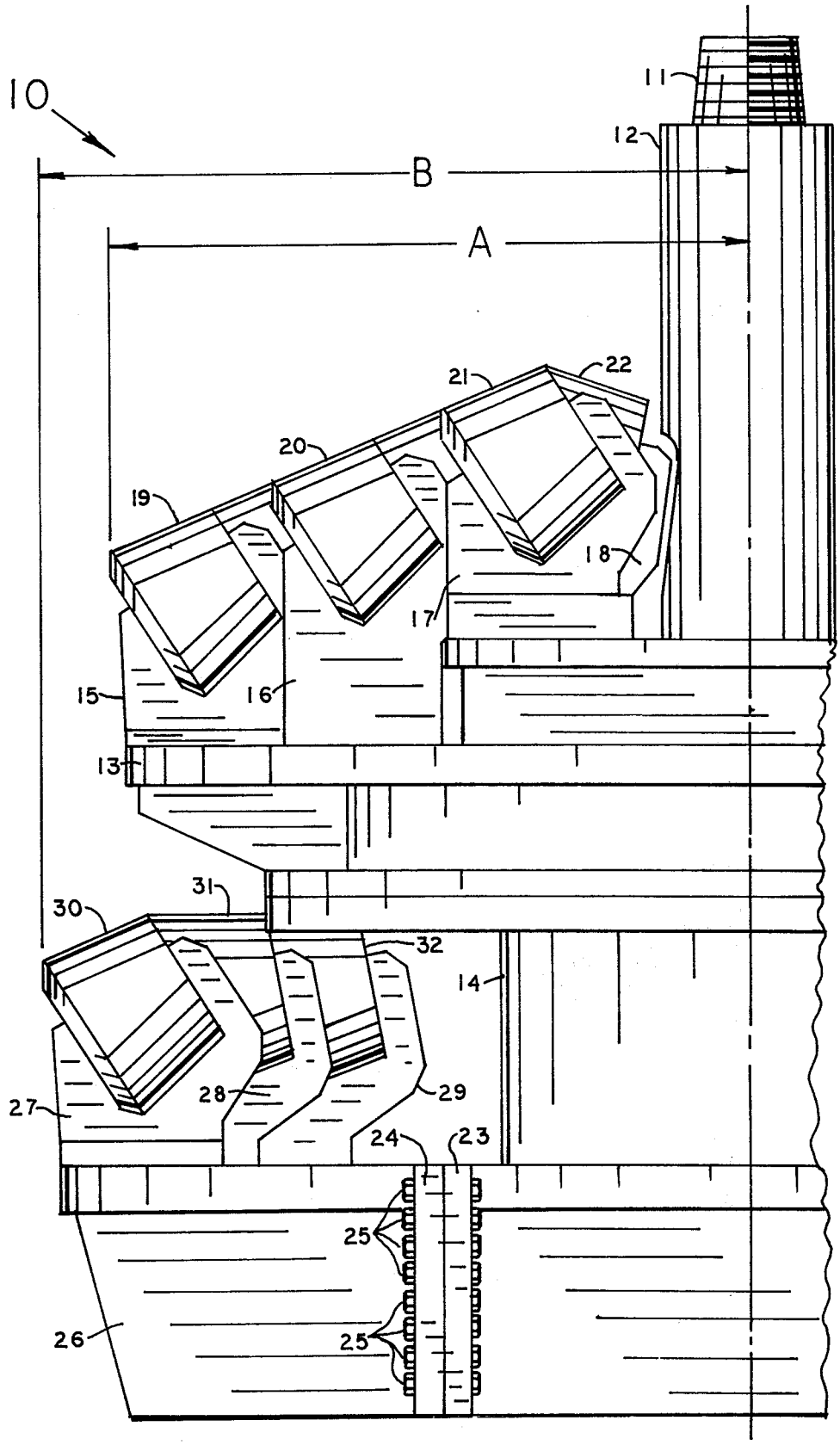
FIG. 1 illustrates a portion of a raise bit constructed in accordance with the present invention.

Referring now to the drawings and, in particular, to FIG. 1, a view of a portion of a raise bit 10 constructed in accordance with the present invention is shown. A drive stem 12 projects from the main body of the raise bit 10. The upper portion of the drive stem 12 is threaded to allow the raise bit 10 to be easily connected to, and disconnected from, a rotary drill string (not shown). During the boring of a large diameter raise hole, a small diameter pilot hole is initially drilled from a first location to a second location. The small diameter pilot bit is disconnected from the drill string and a raise bit such as raise bit 10 is connected to the drill string. The drill string is rotated and an axial force is applied to the drill string. The raise bit such as raise bit 10 is rotated and drawn along the small diameter pilot hole to form the desired large diameter hole.

A first cutting stage for disintegrating the formations out to a first radius "A" from the central axis of bit 10 forms a portion of the body of raise bit 10. The first stage includes a series of cutter saddles 15, 16, 17 and 18 mounted on plates that form a portion of the body of the raise bit 10. Rolling cutters 19, 20, 21 and 22 are mounted in the cutter saddles 15, 16, 17 and 18, respectively. The plate 13 supports the first cutting stage. The first cutting stage includes other cutter saddles and cutters mounted around the stem 12. As the bit 10 is rotated, the first cutting stage will contact and disintegrate the formations out to a first radius "A" from the central axis of the raise bit 10.

A second cutting stage is located below the first cutting stage and is adapted to disintegrate the formations between the first radius "A" and a second radius "B" from the central axis of the raise bit 10. The second or lower cutting stage is connected to the upper or first cutting stage by a cylindrical support member 14. The second cutting stage includes rolling cutters 30, 31 and 32 mounted in cutter saddles 27, 28 and 29, respectively. The cutters and saddles are mounted on a supporting section 26. The supporting section 26 is connected to the body of the raise bit 10 by a series of bolts 25 that extend through holes in a flange 24 extending from the supporting section 26 and holes in a flange 23 extending from the main body of the bit 10.

Under many conditions, it is desirable to expand the drilling diameter of the raise bit 10. For example, should another hole of a larger diameter hole be desired, it would be better to be able to expand the existing raise bit 10 rather than purchase an entirely new bit. The expansion of the bit should be effected without increasing the overall height of the bit. The use of the raise bit is underground, and it is very desirable for the bit to be as compact as possible. This facilitates handling the bit underground. The raise bit 10 shown in FIG. 1 may be quickly and effectively expanded to bore a larger diameter hole. This expansion is accomplished without increasing the overall height of the bit 10.

Figure 2:
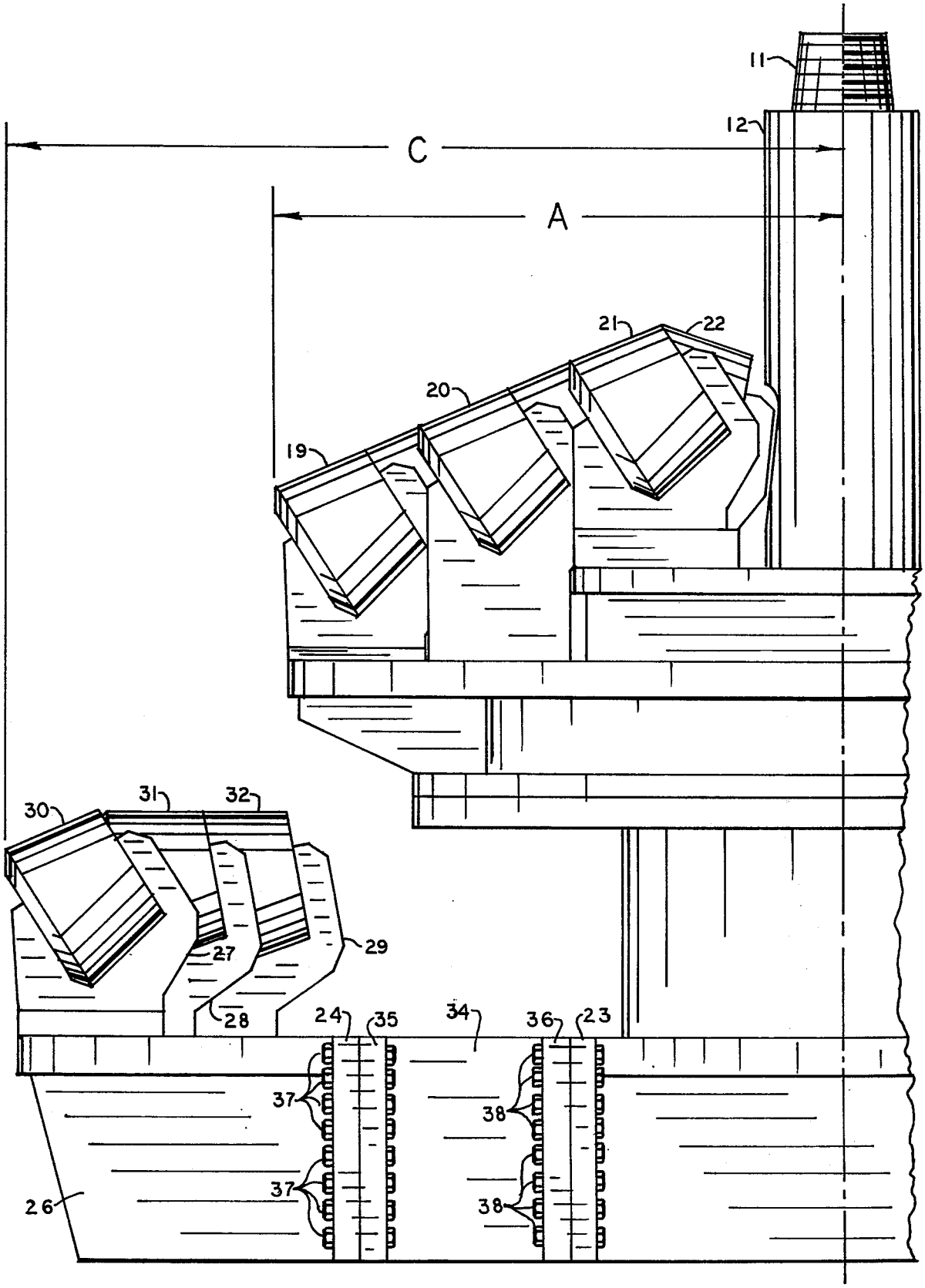
FIG. 2 shows the raise bit of FIG. 1 with means for expanding the raise bit positioned between the secondary cutters and the raise bit body.

Referring now to FIG. 2, the raise bit 10 is shown with the second cutting stage expanded to form a borehole having a radius "C" from the bit axis of rotation. An expander unit 34 is located between the supporting section 26 and the main body of the bit 10. The expander unit 34 is connected to the main body of the bit 10 by a multiplicity of bolts 38 that extend through holes in a flange 36 extending from the expander unit 34 and holes in a flange 23 extending from the main body of the bit 10. The supporting section 26 is connected to the expander unit 34 by a multiplicity of bolts 37 that extend through a corresponding multiplicity of holes in a flange 24 extending from the supporting section 26 and a corresponding multiplicity of holes in a flange 35 extending from the expander unit 34.

Figure 3:
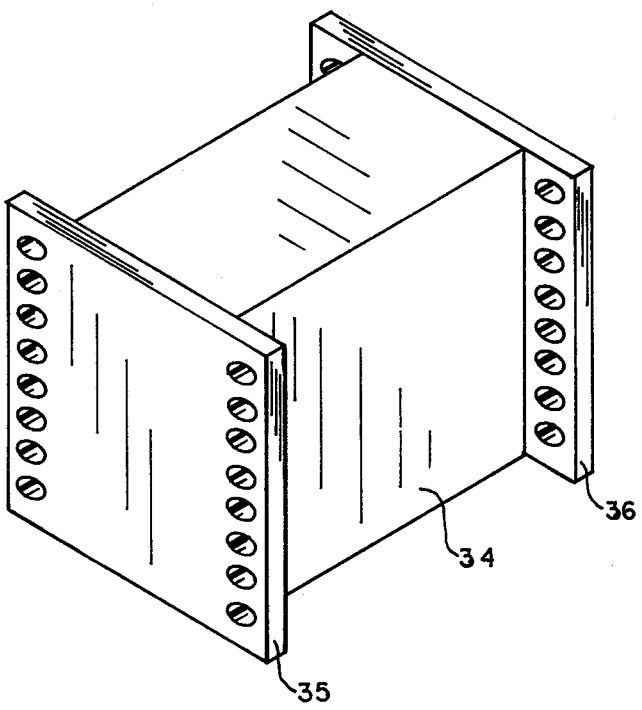
FIG. 3 shows an expansion element adapted to be inserted between the secondary cutters and the raise bit body.

Referring now to FIG. 3, the expander unit 34 is shown in greater detail. The expander unit 34 is adapted to be positioned between the body of the raise bit 10 and the supporting section 26. Flanges 35 and 36 are located on each end of the expander unit 34. Holes in the flanges 35 and 36 allow the expander unit to be securely affixed to the body of the raise bit and securely affixed to the supporting section 26. It will be appreciated that the diameter of the raise bit may be selected by providing expander units of different sizes.

The structural details of a raise bit 10 constructed in accordance with the present invention having been described, a raise drilling operation will now be considered using the raise bit 10 showing in the drawings. The raise drilling operation begins by drilling a small diameter pilot hole through the earth from a first location to an opening at a second location using a small diameter pilot bit. After the pilot hole is completed, the pilot bit is removed from the drill string and the raise bit 10 is attached to the drill string. The raise bit 10 is rotated and drawn along the pilot hole, thereby enlarging the pilot hole to the desired size.

The raise bit 10 is adapted to drill holes of various diameters. For example, should it be desired to drill a hole having a radius "B", the supporting section 26 is connected directly to the main body of the raise bit 10 as shown in FIG. 1. The upper cutting stage including rolling cutters 19, 20, 21 and 22 will disintegrate the formations out to a radius "A". The second or lower cutting stage including rolling cutters 30, 31 and 32 will disintegrate the formations between the radius "A" and the radius "B".

Should it be desired to drill a hole of a larger size, the expander unit 34 is inserted between the supporting section 26 and the main body of the bit 10 as shown in FIG. 2. The upper or first cutting stage including cutters 19, 20, 21 and 22 will disintegrate the formations out to a radius "A" from the central axis of the bit. The second or lower cutting stage including rolling cutters 30, 31 and 32 will disintegrate the formations between the radius "A" and the radius "C". It will be apreciated that by selecting expander units of the appropriate size, it is possible to provide a raise bit that will drill a hole of the desired diameter. It will also be appreciated that, whereas only a portion of the raise bit 10 is shown in FIGS. 1 and 2, the entire raise bit includes a multiplicity of supporting sections 26 generally arranged symmetrically around the drive stem 12.

Figure 4:
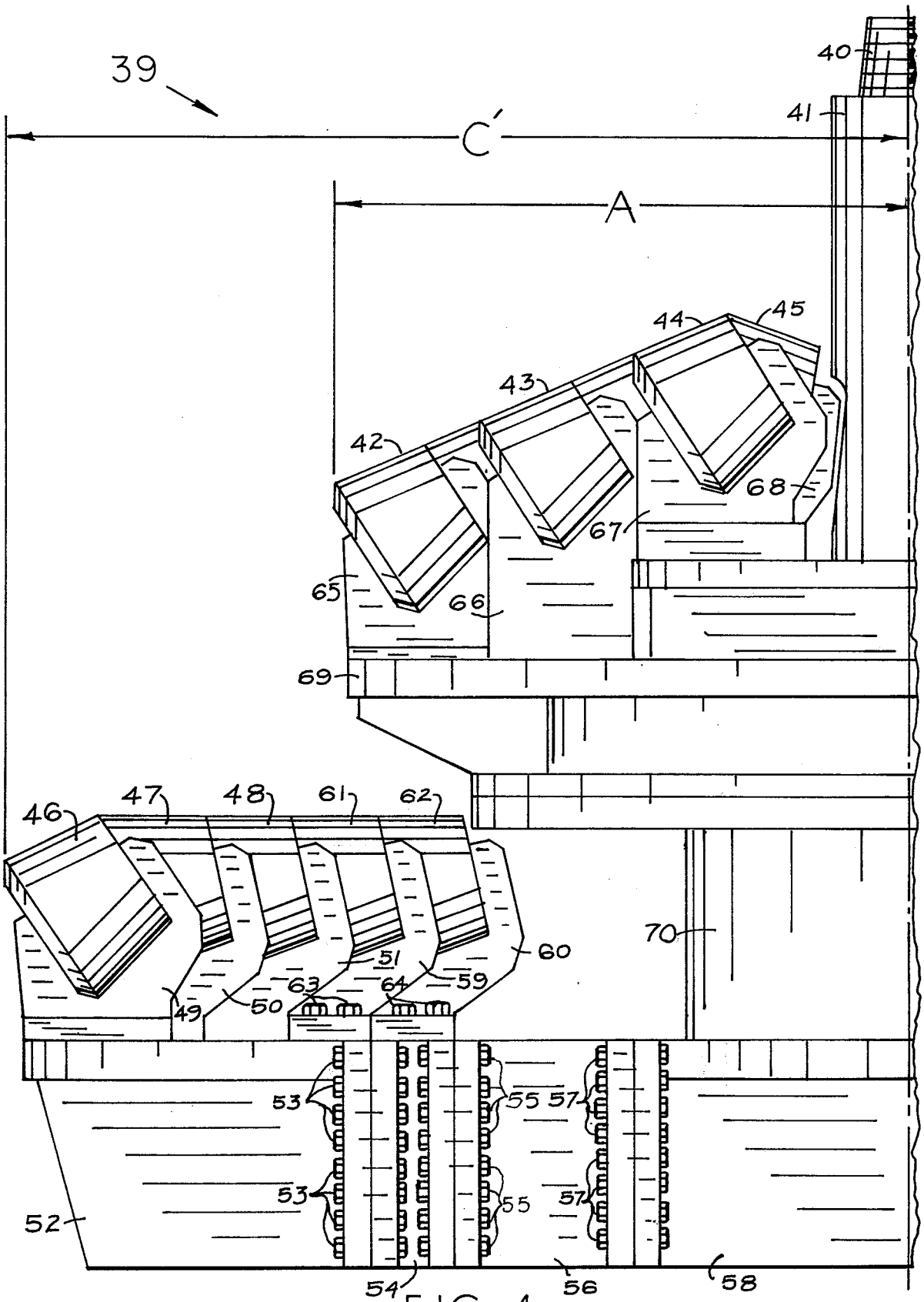
FIG. 4 shows another embodiment of a raise bit constructed in accordance with the present invention.

Referring now to FIG. 4, another embodiment of a raise bit 39 constructed in accordance with the present invention is illustrated. A drive stem 41 projects from the main body of the raise bit 39. The upper portion 40 of the drive stem 41 is threaded to allow the raise bit 39 to be easily connected to, and disconnected from, a rotary drill string (not shown). A first cutting stage for disintegrating the formations out to a first radius A from the central axis of bit 39 forms a portion of the body of raise bit 39. The first stage includes a series of cutter saddles 65, 66, 67 and 68 mounted on plates that form a portion of the body of the raise bit 39. Rolling cutters 42, 43, 44 and 45 are mounted in the cutter saddles 65, 66, 67 and 68, respectively. It is, of course, understood that the first cutting stage also includes other cutters mounted in other saddles positioned around the stem 41. As the bit 39 is rotated, the first cutting stage will contact and disintegrate the formations out to a first radius A from the central axis of the raise bit 39.

A second cutting stage is located below the first cutting stage and is adapted to disintegrate the formations between the first radius A and a second radius C' from the central axis of the raise bit 39. The second, or lower cutting stage, is connected to the upper, or first cutting stage, by a cylindrical support member 70. The second cutting stage includes rolling cutters 46, 47, 48, 61 and 62 mounted in cutter saddles 49, 50, 51, 59 and 60, respectively. The cutters 46, 47, 48 and 61 and saddles 49, 50, 51 and 59 are mounted on an outer supporting section 52. The cutter 62 and saddle 60 are mounted on an intermediate supporting section 54. The outer supporting section 52 is connected to the intermediate supporting section 54 by a series of bolts 53 that extend through holes in a flange extending from the outer supporting section 52 and holes in a flange extending from the intermediate supporting section 54. The intermediate supporting section 54 is connected to an expander unit 56 by a multiplicity of bolts 55 that extend through holes in a flange extending from the expander unit 56 and holes in a flange extending from the intermediate supporting section 54. The expander unit 56 is connected to the main body of bit 39 by a multiplicity of bolts 57 that extend through holes in a flange extending from the expander unit 56 and holes in a flange extending from the lower portion 58 of the main body of the bit 39. The saddle 59 is connected to the outer supporting section 52 by a series of bolts 63 that extend through a flange extending from the saddle 59 and through holes in the outer supporting section 52. The saddle 60 is connected to intermediate supporting section 54 by a series of bolts that extend through holes in a flange extending from saddle 60 and holes in the intermediate section 54.

The structural details of a raise bit 39 constructed in accordance with the present invention having been described, a raise drilling operation will now be considered using the raise bit 39 shown in FIG. 4 of the drawings. The raise drilling operation begins by drilling a small diameter pilot hole through the earth from a first location to an opening at a second location using a small diameter pilot bit. After the pilot hole is completed, the pilot bit is removed from the drill string and the raise bit 39 is attached to the drill string. The raise bit 39 is rotated and drawn along the pilot hole, thereby enlarging the pilot hole to the desired size. The raise bit 39 will drill a hole up to a diameter C′. The upper cutting stage including the rolling cutters 42, 43, 44 and 45 will disintegrate the formations out to a radius A. The second, or lower cutting stage, including rolling cutters 46, 47, 48, 61 and 62 will disintegrate the formations between the radius A and the radius C′.

Should it be desired to either drill a hole of a larger or of a smaller size, the raise bit 39 can be adjusted to provide a raise bit that will drill the desired size hole. For example, if the raise bit 39 is to be adjusted to drill a smaller size hole, the expander unit 56 can be removed and the intermediate supporting section 54 connected directly to the main body of the raise bit 58. The inner saddle 60 can be removed from the intermediate supporting section 54 by removing bolts 64. This allows the intermediate supporting section 54 to be connected directly to the main body of the raise bit 39 without the saddle 60 contacting the tubular supporting section 70. The diameter of the raise bit 39 has been reduced, and a smaller diameter hole can be drilled. Should it be desirable to drill a hole having a larger diameter than the diameter C′, it is possible to increase the diameter of the raise bit 39. The expander unit 56 is removed and a larger expander unit inserted in its place. This will move the cutters 46, 47, 48, 61 and 62 radially outward increasing the diameter of the bit 39. Should it be desired to increase the bit to an even larger diameter an additional section similar to the intermediate supporting section 54 is positioned between the outer supporting section 52 and the main body 58 of the raise bit 39. The additional intermediate sections will include a saddle like saddle 60 and an additional cutter like cutter 62.

The embodiments of the invention in which an exclusive property or privilege is claimed are defined as follows:

1. A raise bit for enlarging a first hole into a larger second hole by being drawn through said first hole and disintegrating earth formations surrounding said first hole, comprising:

a drive stem;

a raise bit body connected to said drive stem, said drive stem defining a bit axis of rotation;

primary cutter means positioned on said bit body for disintegrating the formations out to a first radial distance from said bit axis of rotation;

secondary cutter means adapted to be connected to said bit body selectively located in a first position for disintegrating the formations between said first radial distance and a second radial distance from said bit axis of rotation, said second radial distance being greater than said first radial distance, and selectively located in subsequent positions for disintegrating the formations between said first radial distance and subsequent radial distances from said bit axis of rotation, said subsequent radial distances being greater than said second radial distance; and expansion means adapted to be located between said secondary cutter means and said bit body for locating said secondary cutter means in said subsequent positions.

2. A bit for enlarging a first hole into a larger second hole, comprising:

a bit body defining a bit axis of rotation;

primary cutter means positioned on said bit body for disintegrating the formations out to a first radial distance from said bit axis of rotation;

secondary cutter means adapted to be connected to said bit body selectively located in a first position for disintegrating the formations between said first radial distance and a second radial distance from said bit axis of rotation, said second radial distance being greater than said first radial distance, and selectively located in subsequent positions for disintegrating the formations between said first radial distance and subsequent radial distances from said bit axis of rotation, said subsequent radial distances being greater than said second radial distance;

expansion means adapted to be located between said secondary cutter means and said bit body for locating said secondary cutter means in said subsequent positions; and additional cutter means positioned on said expansion means.

* * * * *